US010550460B2

(12) United States Patent
Nilsson et al.

(10) Patent No.: US 10,550,460 B2
(45) Date of Patent: Feb. 4, 2020

(54) MATERIAL FOR HIGH VELOCITY OXY FUEL SPRAYING, AND PRODUCTS MADE THEREFROM

(71) Applicants: Lars-åke Nilsson, Höganäs (SE); Peter Olsérius, Helsingborg (SE)

(72) Inventors: Lars-åke Nilsson, Höganäs (SE); Peter Olsérius, Helsingborg (SE)

(73) Assignee: HÖGANÄS AB (PUBL), Högnäs (SE)

( * ) Notice: Subject to any disclaimer, the term of this patent is extended or adjusted under 35 U.S.C. 154(b) by 1217 days.

(21) Appl. No.: 14/362,701

(22) PCT Filed: Dec. 5, 2012

(86) PCT No.: PCT/EP2012/074432
§ 371 (c)(1),
(2) Date: Jun. 4, 2014

(87) PCT Pub. No.: WO2013/083599
PCT Pub. Date: Jun. 13, 2013

(65) Prior Publication Data

US 2014/0356223 A1 Dec. 4, 2014

(30) Foreign Application Priority Data

Dec. 5, 2011 (EP) ..... 11191917

(51) Int. Cl.
*C23C 4/06* (2016.01)
*C22C 19/05* (2006.01)
*C22C 30/00* (2006.01)

(52) U.S. Cl.
CPC ..... *C23C 4/06* (2013.01); *C22C 19/057* (2013.01); *C22C 30/00* (2013.01)

(58) Field of Classification Search
CPC ..... C22C 1/023; C22C 1/0433; C22C 19/057; C22C 27/04; C22C 30/00; B22F 3/115; B22F 7/008; B22F 2301/15; B22F 2304/10; C23C 4/04; C23C 4/06; C23C 4/08
See application file for complete search history.

(56) References Cited

U.S. PATENT DOCUMENTS

| | | | | |
|---|---|---|---|---|
| 3,305,326 | A | 2/1967 | Longo | |
| 5,019,459 | A * | 5/1991 | Chou | B29C 45/62 420/431 |
| 5,328,763 | A | 7/1994 | Terry | |
| 6,049,978 | A * | 4/2000 | Arnold | B23K 20/021 29/402.07 |
| 6,562,480 | B1 * | 5/2003 | Stong | C23C 4/06 29/888.074 |
| 7,291,384 | B2 * | 11/2007 | Obara | C23C 4/06 427/455 |
| 2009/0140030 | A1 | 6/2009 | Amancherla et al. | |

FOREIGN PATENT DOCUMENTS

| | | | |
|---|---|---|---|
| BR | P1 0400134 | A | 9/2004 |
| BR | PI0400134 | A * | 9/2004 |
| EP | 0 223 135 | A1 | 5/1987 |
| EP | 2 055 424 | A2 | 5/2009 |
| GB | 1016629 | A | 1/1966 |
| JP | 55-125249 | A | 9/1980 |

OTHER PUBLICATIONS

Sudhangshu Bose, "Overlay Coatings by Spray and Arc Processes," High Temperature Coatings, Ch. 6.5, 2007, pp. 97-116.*
International Search Report (PCT/ISA/210) dated Apr. 4, 2013, by the European Patent Office as the International Searching Authority for International Application No. PCT/EP2012/074432.
Written Opinion (PCT/ISA/237) dated Apr. 4, 2013, by the European Patent Office as the International Searching Authority for International Application No. PCT/EP2012/074432.

* cited by examiner

*Primary Examiner* — Vanessa T. Luk
(74) *Attorney, Agent, or Firm* — Buchanan Ingersoll & Rooney P.C.

(57) ABSTRACT

The inventors have developed a new alloy which is useful in HVOF-spraying of a substrate, such as plungers which are used in glass manufacture. When coated with said alloy, these parts display high wear resistance and consequently longer lifetime.

6 Claims, No Drawings

MATERIAL FOR HIGH VELOCITY OXY FUEL SPRAYING, AND PRODUCTS MADE THEREFROM

BACKGROUND

Thermal surfacing with self-fluxing nickel based alloys plays an important role in the wear protection of tools in the glass container industry. Bottle machine tools work under very severe conditions, subjected to both wear, corrosion and fast thermal cycling.

Major properties of self-fluxing nickel based alloys are good abrasive resistance and good corrosion resistance at high temperatures. This has led to the extensive use of nickel alloys for surfacing cast iron parts in the glass bottle manufacturing industry. Hardfacing processes with powder welding, Flame spraying, High velocity oxy-fuel (HVOF) spraying and PTA welding use self-fluxing powder in the production of new molds, plungers, baffles, neck rings, plates etc. as well as for repair and maintenance.

Essential elements in a self-fluxing alloy are silicon (Si) and boron (B). These two elements have a very strong influence on the liquidus temperature. The melting temperature for pure nickel (Ni) is 1455° C. The alloy liquidus can be reduced to below 1000° C. by increased concentration of Si and B. The melting temperature range is defined by the solidus and liquidus (FIG. 2a/2b). The low melting points of the self-fluxing alloys is of great advantage, as these can be coated without fusion to the base metal. Alloys normally contain chrome (Cr), iron (Fe) and carbon (C), and at times molybdenum (Mo), tungsten (W) and copper (Cu) are also added. Other metallic oxides, such as Fe and Ni oxides, dissolved with Si and B have the ability to form silicates. This may be important during application of nickel based alloys, as the Si—B slag acts as a welding flux. This protects the fresh metal surface from being oxidized and ensures better wettability for the molten metal.

The microstructure of Ni—Cr—Si—B-alloys is a relatively ductile Ni-rich matrix with various amounts of hard particles. Increasing the amount of alloying elements increases the number of hard particles and consequently the hardness of the alloy. Increased hardness also makes the material more difficult to machine. In soft alloys with low concentrations of Si, B and Cr the predominant hard phase is Ni3B.

It is desirable to produce molds, plungers, baffles, neck rings, and plates with prolonged lifetime, and there is consequently a need to develop new alloys which can achieve this.

SUMMARY OF THE INVENTION

In the glass mould industry, HVOF (High Velocity Oxy-Fuel) spraying is normally used for coatings on narrow neck plungers and to a limited extent press and blow plungers.

The inventors have developed a new alloy which is useful in HVOF(High Velocity Oxy Fuel spraying)-treatment of a substrate used in glass manufacture, such as plungers. When treated with said alloy, these parts display high wear resistance and consequently longer lifetime.

The components included in the alloy can be supplied in powder form.

Said powder is deposited on the substrate by using an HVOF spraying process.

DETAILED DESCRIPTION

It is an object of the invention to provide a nickel based powder which can be used in an HVOF spraying process, the powder consisting of (all percentages in wt %) carbon 2.2-2.85; silicon 2.1-2.7; boron 1.2-1.7; iron 1.3-2.6; chromium 5.7-8.5; tungsten 32.4-33.6; cobalt 4.4-5.2; the balance being nickel.

In a further embodiment, the powder consists of (all percentages in wt %) carbon 2.3-2.7; silicon 2.15-2.6; boron 1.4-1.6; iron 1.5-2.05; chromium 7.3-7.5; tungsten 32.4-33.6; cobalt 4.4-5.2; the balance being nickel.

In one embodiment, the powder includes 2 types of powder; alloy 1 being a soft alloy, and alloy 2 being a hard alloy. In this context, the terms "soft alloy" and "hard alloy" are meant to define two alloys with one being softer than the other. The two different alloys have the following compositions;

| Alloy | C | Si | B | Fe | Cr | Ni |
|---|---|---|---|---|---|---|
| 1 | 0.25% | 3.5 | 1.6 | 2.5 | 7.5 | Balance |
| 2 | 0.75% | 4.3 | 3.1 | 3.7 | 14.8 | Balance |

In one embodiment, the powder has a particle size of 12-58 μm or 15-53 μm or 20-53 μm as measured by sieve analysis.

An additional object of the present invention is to provide an alloy manufactured by the nickel based powder.

An additional object of the invention is to provide components coated by said alloy, preferably coated by HVOF (High Velocity Oxy Fuel spraying).

The HVOF process for coating glass plungers consists of two steps: spraying with a spray gun and fusing of the deposit with a fusing torch. The powder is fed into an oxy-acetylene or oxy-hydrogen gun by injection and is projected towards the base material at high speed. The hot particles flatten under impact and interlock both with the base material and each other, forming a mechanical bond.

A fusion treatment is required to obtain a dense and well bonded coating of the sprayed layer. The coating is heated to a temperature between its solidus and liquidus—normally around 1000° C. At optimum temperature, the material is a mix of melted and solid particles. Shrinkage of 15-20% takes place during fusing, when the melt fills the gaps between the particles.

Depending on the type of gas and brand of spray gun both fine and coarse powders can be used. The market's most common types of HVOF spray equipment are Metco Diamond Jet, Tafa JP5000, or Tafa JP8000. All are excellent for this kind of work with a broad choice of materials and the highest productivity in kg sprayed powder per hour.

The powder flow rate should be correctly adjusted. If the flow rate is too low, it causes overheating, and if it is too high the particles will be insufficiently heated—in both cases this leads to an inferior layer quality with pores or oxides. The coarsest sections of the plunger were preheated to 200-300° C. Several layers of powder are then sprayed. The gun is normally used in a robotic setup and the gun should be moved with a smooth, even action and should never be held still, as this cause the coating to overheat. It should be taken into account that the layer shrinks about 20% during the subsequent fusing. A normal thickness after fusing is 0.6-0.8 mm.

After spraying, the deposit must be fused. A fusing burner of adequate size is used, i.e. a 1,000 l/min burner capacity for small plungers and up to 4,000 l/min for large plungers. If a burner is too small, this may lead to an excessively long fusing time, resulting in an oxidized layer. Fusing with a burner that is too large will overheat the layer and give rise to pores or unevenness. The plunger should be heated to about 900° C. The flame should then be adjusted to acetylene gas surplus—a so-called "soft flame". Start the fusing about 30 mm from the top. When the coating begins to shine like a mirror, move the flame towards the point of the plunger and fuse that section first. Return to the starting point and complete the fusing of the plunger. It is recommended that dark welding glasses are worn, in order to see the shine correctly. If fusing temperature is too low, insufficient material will melt. After spraying, the deposit must be fused. A fusing burner of adequate size is used, i.e. a 1,000 l/min burner capacity for small plungers and up to 4,000 l/min for large plungers. If a burner is too small, this may lead to an excessively long fusing time, resulting in an oxidized layer. Fusing with a burner that is too large will overheat the layer and give rise to pores or unevenness. This results in bad adherence properties and high porosity. Too much heat causes failures such as sagging of the deposit, dilution, distortion of the base material and excessive fluxing, which creates excessive slag and makes the deposit too soft. When spraying a plunger with a diameter of less than 25 mm, it is more economical to use an additional air cap on the gun. This concentrates the powder stream on the plunger's small surface area. Thus spraying time is reduced and deposition efficiency increased.

After fusing, the plunger is cooled to about 600° C. under rotation. Thereafter, it can be left to cool slowly in air. If a hard alloy (50-60 HRC) is used, it is recommended that the piece is placed in a heat-insulating material such as vermiculite. This will slow the cooling to prevent cracks.

Narrow neck plungers have a diameter of less than 25 mm and require hard and dense coatings. It is therefore more economical to use the HVOF-process. This has a more concentrated flame than flame spraying and creates very dense coatings due to the high speed of the powder particles. HVOF requires finer powder than flame spraying. The most common solution is a powder with a particle size range of 20-53 micron. Some HVOF systems require even finer powders such as 15-45 micron. Most HVOF coatings can be used without fusing. In the case of narrow neck plungers, fusing of the coating is normally required.

EXAMPLES

Example 1

Three powder mixtures were prepared, having the following compositions (balance being nickel):

| Element | Sample 1 | Sample 2 | Reference |
|---|---|---|---|
| C | 2.2-2.7 | 2.30-2.85 | 1.95-2.50 |
| Si | 2.1-2.6 | 2.15-2.7 | 2.30-3.00 |
| B | 1.2-1.5 | 1.50-1.70 | 1.50-1.90 |
| Fe | 1.30-2.05 | 1.50-2.60 | 1.40-2.70 |
| Cr | 5.7-7.5 | 7.30-8.50 | 7.10-8.70 |
| W | 32.-33.6 | 32.4-33.6 | 26.80-28.10 |
| Co | 4.4-5.2 | 4.4-5.2 | 3.60-4.40 |

Example 2

The powders may be used for coating a disk which was then used in a wear test (a so-called pin on disk test, shown in example 3). HVOF-spraying was used to coat the disk.

The HVOF spraying process is normally performed in one step. However, for plungers, two steps are carried out; spraying with a HVOF spray gun and fusing of the deposit with a fusing torch. The powder is fed into the gun from a powder feeder hopper using argon gas as a carrier.

The common types of HVOF spray equipment on the market, such as Metco Diamond Jet, Tafa JP5000, Tafa JP8000, and others may be used in this example.

Several layers of powder were sprayed onto the disk (or, where applicable, the plunger). The gun should be moved with a smooth, even action and should not be held still, as this causes the coating to overheat.

The coating is thereafter heated with a fusing torch to a temperature between its solidus and liquidus at around 1000° C. A fusing burner of adequate size is used, i.e. a 1,000 l/min burner capacity for small plungers and up to 4,000 l/min for large plungers. If a burner is too small, this may lead to an excessively long fusing time, resulting in an oxidized layer. Fusing with a burner that is too large will overheat the layer and give rise to pores or unevenness. The disk may be heated to about 900° C. The flame may then be adjusted to acetylene gas surplus—a so-called "soft flame". Start the fusing about 30 mm from the top. When the coating begins to shine like a mirror, fusing is started. Return to the starting point and complete the fusing of the disk. It is recommended that dark welding glasses are worn, in order to see the shine correctly. If fusing temperature is too low, insufficient material will melt. After spraying, the deposit be fused. A fusing burner of adequate size is used, i.e. a 1,000 l/min burner capacity for small plungers and up to 4,000 l/min for large plungers. If a burner is too small, this may lead to an excessively long fusing time, resulting in an oxidized layer.

After fusing, the plunger is cooled to about 600° C. under rotation. Thereafter, it can be left to cool slowly in air. If a hard alloy (50-60 HRC) is used, it is recommended that the piece is placed in a heat-insulating material such as vermiculite. This will slow the cooling to prevent cracks.

Example 3

The HVOF coated disk is subjected to a "pin on disk" wear test. The test is performed according to standard ASTM G65, at a temperature between 500° C. and 550° C. with a 2 hour continual pressure on the ball. The coatings made from the samples according to the invention had a wear coefficient which was approximately 3 times lower than that of the reference material. This indicates a high wear resistance compared to the reference material.

The invention claimed is:

1. A metal powder consisting of (all percentages in wt %) carbon 2.2-2.85; silicon 2.1-2.7; boron 1.4-1.6; iron 1.3-2.6; chromium 5.7-8.5; tungsten 32.4-33.6; cobalt 4.4-5.2; the balance being nickel, wherein the powder is configured to be sprayed by a HVOF spraying process and has a particle size of 12-58 μm as measured by sieve analysis.

2. Metal powder according to claim 1, the powder consisting of carbon 2.3-2.7; silicon 2.15-2.6; boron 1.4-1.6; iron 1.5-2.05; chromium 7.3-7.5; tungsten 32.4-33.6; cobalt 4.4-5.2; the balance being nickel.

3. Metal powder according to claim 1, the particle size of the powder is 20-53 μm as measured by sieve analysis.

4. Method for coating a surface by high velocity oxy fuel spraying, wherein the powder according to claim 1 is used.

5. Component manufactured by the method according to claim 4.

6. A metal powder consisting of (all percentages in wt %):
carbon 2.2-2.85;
silicon 2.1-2.7;
boron 1.4-1.6;
iron 1.3-2.6;
chromium 7.3-7.5;
tungsten 32.4-33.6;
cobalt 4.4-5.2;
the balance being nickel,
wherein the powder has a particle size of 12-58 μm as measured by sieve analysis.

* * * * *